US010905290B1

(12) United States Patent
Tejada

(10) Patent No.: US 10,905,290 B1
(45) Date of Patent: Feb. 2, 2021

(54) GRASPING DEVICE

(71) Applicant: Alfonso Tejada, Miami, FL (US)

(72) Inventor: Alfonso Tejada, Miami, FL (US)

( * ) Notice: Subject to any disclaimer, the term of this patent is extended or adjusted under 35 U.S.C. 154(b) by 0 days.

(21) Appl. No.: 16/870,452

(22) Filed: May 8, 2020

(51) Int. Cl.
*A47K 5/00* (2006.01)
*A47K 5/12* (2006.01)

(52) U.S. Cl.
CPC ..... *A47K 5/1207* (2013.01)

(58) Field of Classification Search
CPC ..... A47K 5/1207; E05B 1/0069
USPC ..... 222/192
See application file for complete search history.

(56) References Cited

U.S. PATENT DOCUMENTS 4,036,406 A * 7/1977 Jespersen ..... A47K 5/1204 222/181.2
2006/0188317 A1* 8/2006 Schwarz ..... C11D 17/049 401/123
2007/0046050 A1 2/2007 Metzger et al.
2010/0123023 A1* 5/2010 Schnuckle ..... A45B 23/00 239/289
2011/0139090 A1* 6/2011 Harruna ..... A01K 27/006 119/796
2012/0080451 A1* 4/2012 Williams ..... A61L 2/22 222/181.3
2016/0008502 A1* 1/2016 LaBonte ..... A61L 2/22 239/302
2018/0015238 A1* 1/2018 Schwab ..... A61M 35/003
2020/0086477 A1* 3/2020 Fulkerson ..... B25J 1/04

FOREIGN PATENT DOCUMENTS

DE 202020100435 * 3/2020 ..... E03D 9/00
WO WO2013017521 * 2/2013 ..... E05B 1/0053

* cited by examiner

*Primary Examiner* — J C Jacyna
(74) *Attorney, Agent, or Firm* — Sanchelima & Associates, P.A.; Christian Sanchelima; Jesus Sanchelima

(57) ABSTRACT

A grasping device including a housing assembly, a lid assembly, a hook assembly and a cartridge assembly is disclosed. The housing assembly importantly houses the hook assembly. The hook assembly includes a hook and bumper which are extendable from one distal end of the housing. A user grasps surfaces, such as a handle, with the hook and bumper, avoiding the spreading of infectious diseases through indirect contact. The cartridge assembly includes a replaceable cartridge housed within the housing at an opposite distal end thereof. The cartridge dispenses a sanitizing solution to allow the user to disinfect any desired surface. The lid assembly includes a hingedly mounted lid that is used to cover the cartridge stored within the cavity or other contents stored with the cavity. The grasping device allows a user to increase their health and sanitization by avoiding contact with surfaces that are unknowingly riddled with infectious diseases.

20 Claims, 10 Drawing Sheets

GRASPING DEVICE

BACKGROUND OF THE INVENTION

1. Field of the Invention

The present invention relates to a grasping device and, more particularly, to a grasping device that allows a user to grasp items or surfaces hygienically to reduce the transmission of infectious diseases amongst people from indirect contact.

2. Description of the Related Art

Several designs for grasping devices have been designed in the past. None of them, however, include a device having a hook portion on one distal end and a sanitization solution dispenser on an opposite distal end. The hook portion allows a user to grasp a surface, such as that of a door handle, without the need to come into direct contact with the surface. Hence preventing the user from becoming contaminated by any infectious agents found on the grasped surface. The sanitation solution dispenser allows the user to be readily able to cleanse, disinfect or sanitize themselves, others or a surface. Preferably, the device may be attached to a keychain for ease of transportation. The present invention helps to improve the health of users by reducing the spreading of infectious diseases and agents through indirect contact.

Applicant believes that a related reference corresponds to U.S. published application No. 2020/0086477 for a compact and portable door pull for sanitary use that provides a method of opening a door, so the user doesn't need to touch the door handle this lessening the likelihood of any germ/bacteria transmission. Applicant believes that another related reference corresponds with U.S. published application No. 2007/0046050 for a compact, readily portable handheld article grasping apparatus for grasping articles such as door handles, gate handles, mailbox handles and the like. None of these references, however, teach of a door opening device that is capable of opening doors, providing a sanitization solution to the user and includes a compartment for storage.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a grasping device that increases the sanitation and cleanliness of users.

It is another object of this invention to provide a grasping device that helps to prevent the transmission and spreading of infectious agents such as germs, viruses or bacteria through indirect contact.

It is still another object of the present invention to provide a grasping device that is readily portable to allow a user to be readily able to reduce their exposure to infectious agents.

It is also another object of the present invention to provide a grasping device that helps to improve the health of the user by reducing the chances the user has of becoming ill.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
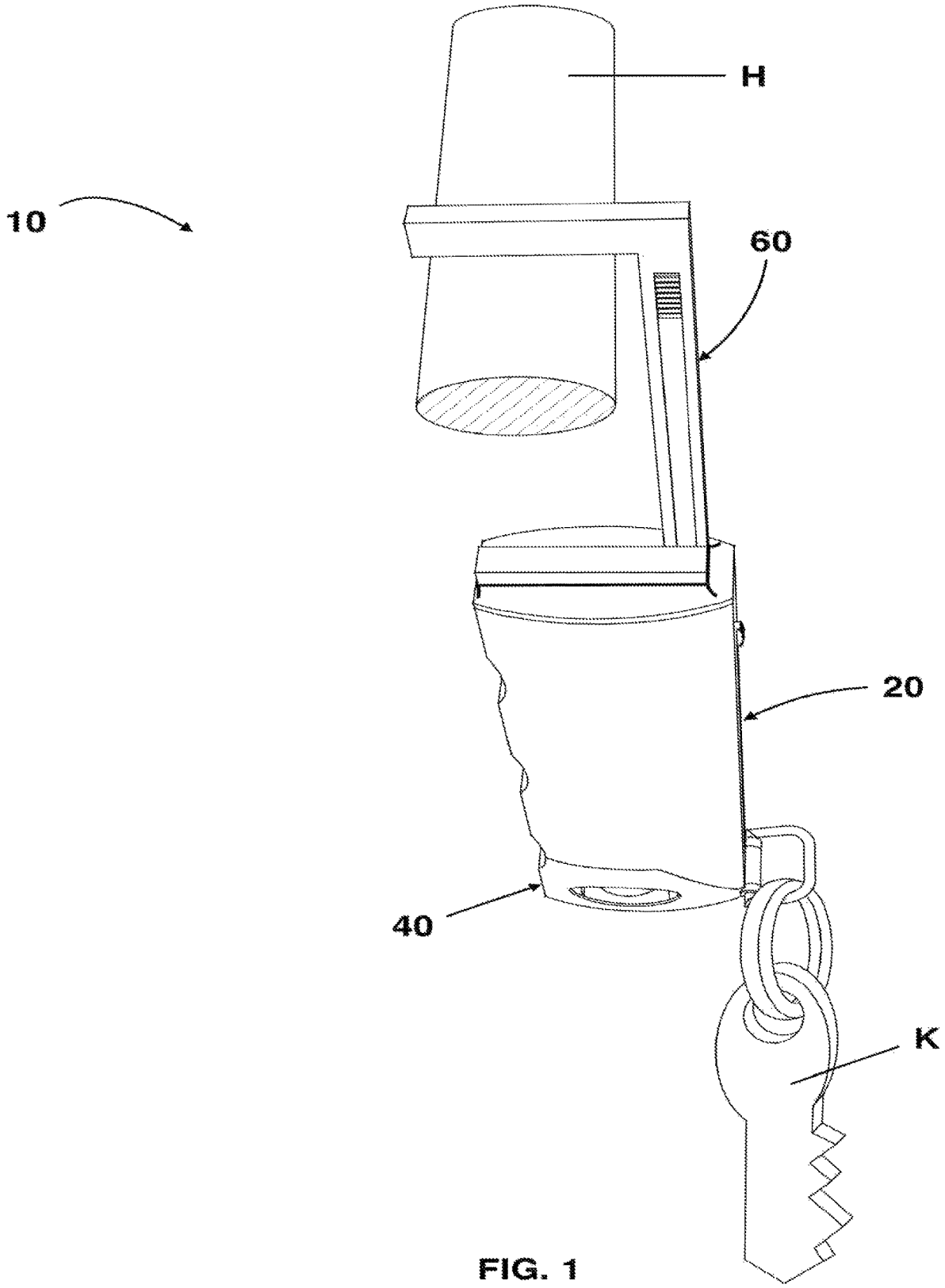
FIG. 1 represents an operational setting in which grasping device 10 is used to grasp a door handle H.

Referring now to the drawings, where the present invention is generally referred to with numeral 10, it can be observed that it basically includes a housing assembly 20, a lid assembly 40, a hook assembly 60 and a cartridge assembly 80.

As best seen in FIG. 1, it can be seen that a grasping device 10 may be used to grasp a surface or item such as handle H, allowing a user to open a door with handle H without needing to make direct contact with handle H. Thereby reducing the chances of contamination or spreading of infectious diseases through indirect contact from person to person. This helps to maintain a user healthy and safe. Grasping device 10 may be readily portable and attached to keys K, as shown in FIG. 1. Assisting the user to be readily able to take precautionary measures to maintain themselves healthy by reducing the chances of becoming ill with an infectious disease through indirect contact.

Housing assembly 20, as best seen in FIGS. 2 through 5, may include a housing 22. Housing 22 may be the body of grasping device 10. Housing 22 may suitably be made of materials such as wood, plastic, metal, stainless steel, rubber, acrylic, glass, or combinations thereof. Housing 22 may be ridged for added durability. Housing 22 may preferably have a substantially elongated shape. It is to be understood that the shape of housing 22 may be irregular. Housing 22 may preferably be of dimensions that make grasping device 10 portable. It is to be understood that housing 22 may be substantially hollow to enclose and house hook assembly 60 and cartridge assembly 80 therein.

Figure 4:
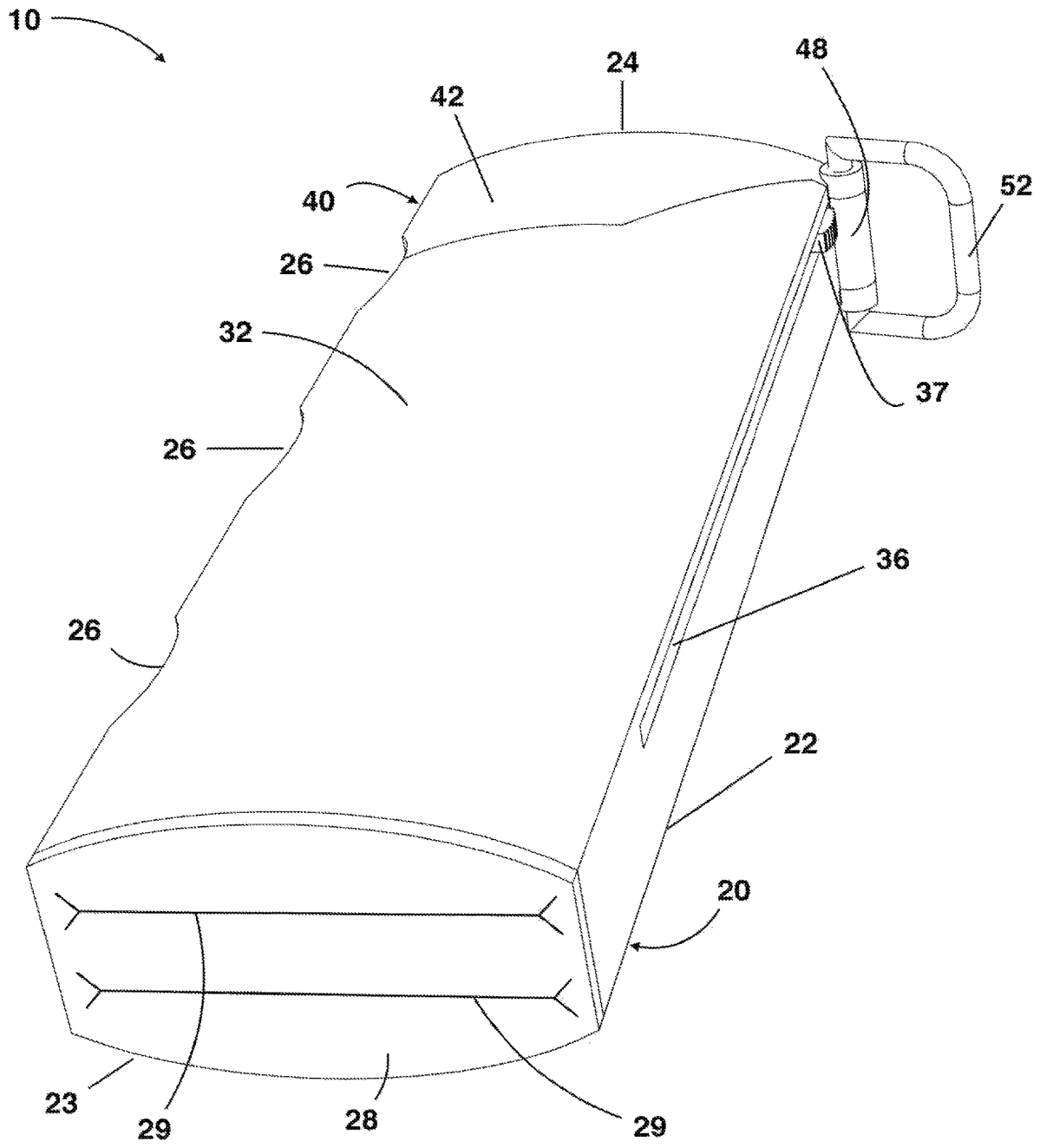
FIG. 4 is a representation of an isometric front view of grasping device 10 with hook assembly 60 retracted therein.
Figure 5:
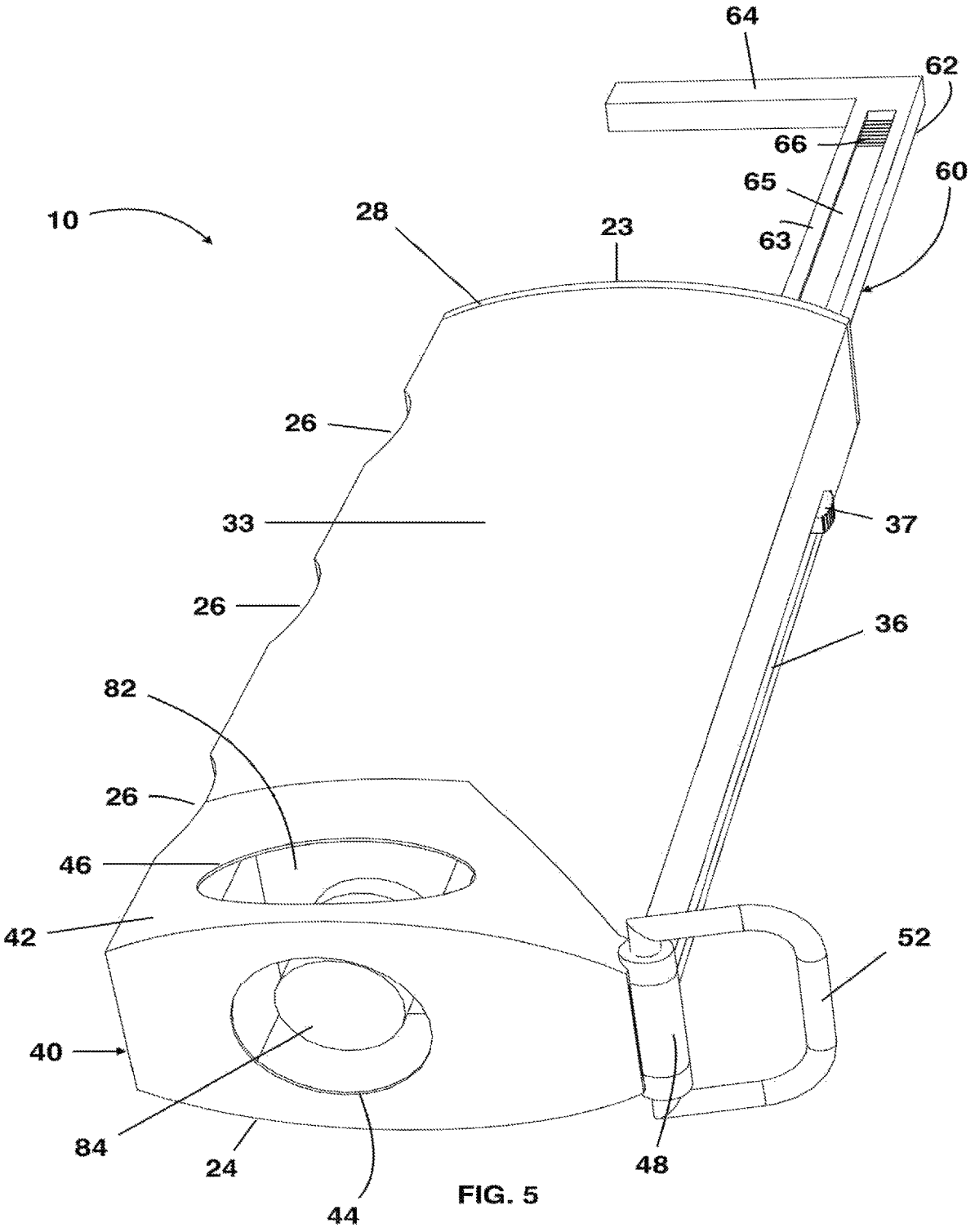
FIG. 5 represents an isometric rear view of grasping device 10 with lid assembly 40 in the closed configuration.

Grasping device 10 may include a front and rear. More specifically, housing 22 may include a front side 23 and a rear side 24, as best seen in FIGS. 4 and 5, respectively. During operational use of grasping device 10, front side 23 may face away from the user. At front side 23 may be located hook assembly 60. It may be suitable for hook assembly 60 to be seen expanding or retracting into housing 22 from front side 23. At rear side 24 may be lid assembly 40 and cartridge assembly 80.

Housing 22 may further include a grip portion 26 at a bottom side of housing 22. Grip portion 26 may facilitate the grasping and operation of grasping device 10 by the user. Grip portion 26 may allow user to ergonomically operate the grasping device 10. Grip portion 26 may comfortably receive the fingers of the user while grasping device 10 is palmed by the user. Grip portion 26 may be defined by ridges and indentations extending between the ridges. The fingers of the users may be placed on the indentations of grip portion 26. Grip portion 26 may preferably extend the length of housing 22. Grip portion 26 further allows for the effective and efficient usage of the present invention.

At front side 23 housing 22 may be seen a cover 28 as best seen in FIGS. 1 and 4. Cover 28 may conceal hook assembly 60 when retracted within housing 22. Cover 28 may be made of a flexible material such as rubber, in one embodiment. Cover 28 may have an oblong shape. It may be suitable for cover to be of a shape and dimensions that cooperate with fitting flushly onto housing 22. Cover 28 may include openings 29. Openings 29 may extend vertically along cover 28. In the preferred embodiment, openings 29 may partially extend along the height of cover 28. It may be suitable for openings 29 to be adjacent and parallel to each other. Openings 29 permit for different components of hook assembly 60 to extend or retract therethrough.

At rear side 24 of housing 22 may be a cavity 31. In one embodiment, cavity 31 may extend the length of housing 22. Preferably, cartridge assembly 80 may be housed and secured within cavity 31. As such, cavity 31, may be of a shape and dimension that cooperates with a cartridge 82 of cartridge assembly 80. It is to be understood that cartridge assembly 80 may be removable from cavity 31. Alternatively, cavity 31 may also be used to store items such as medications or other personal belongings of the user.

Figure 2:
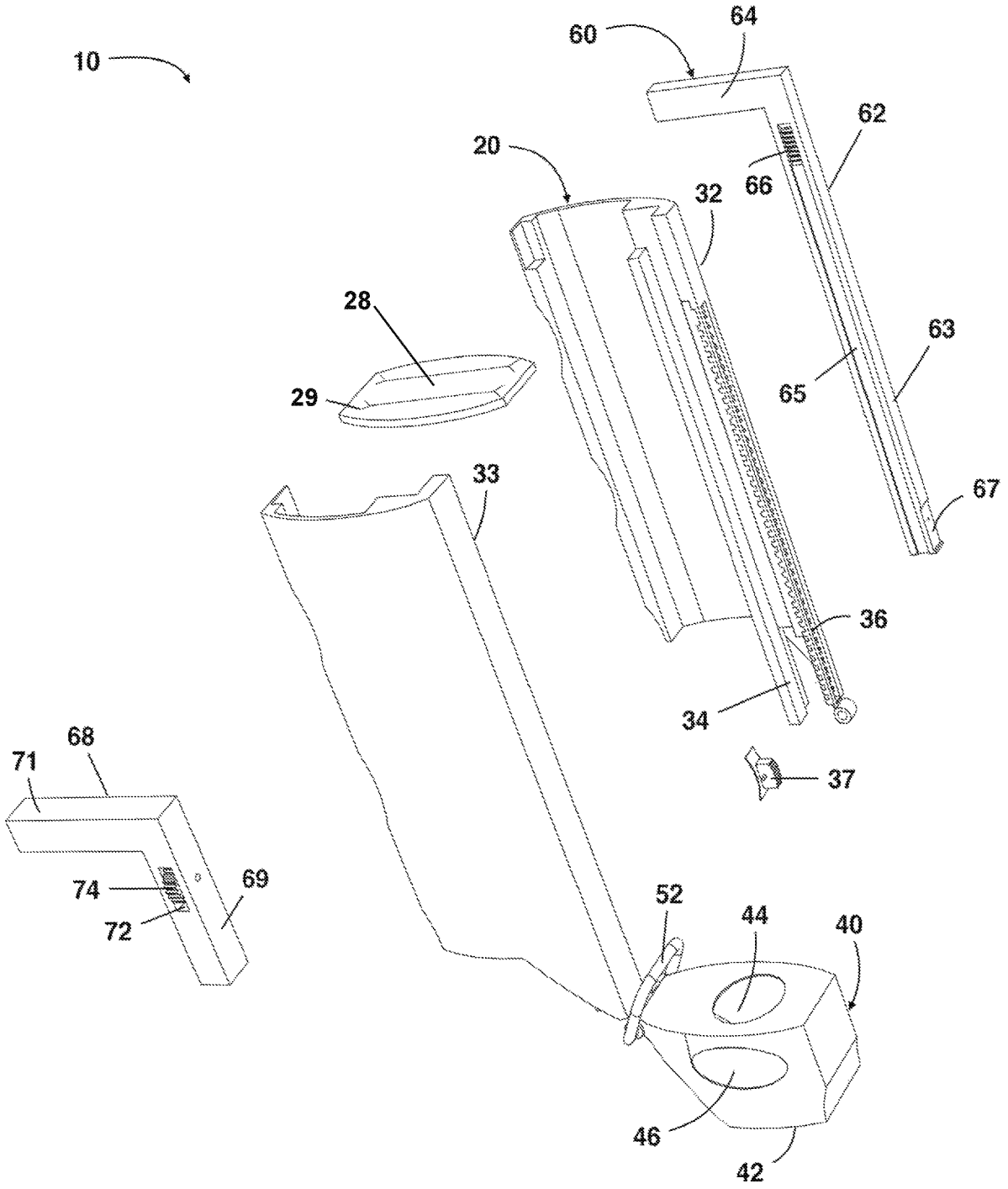
FIG. 2 shows an exploded view of grasping device 10.
Figure 3:
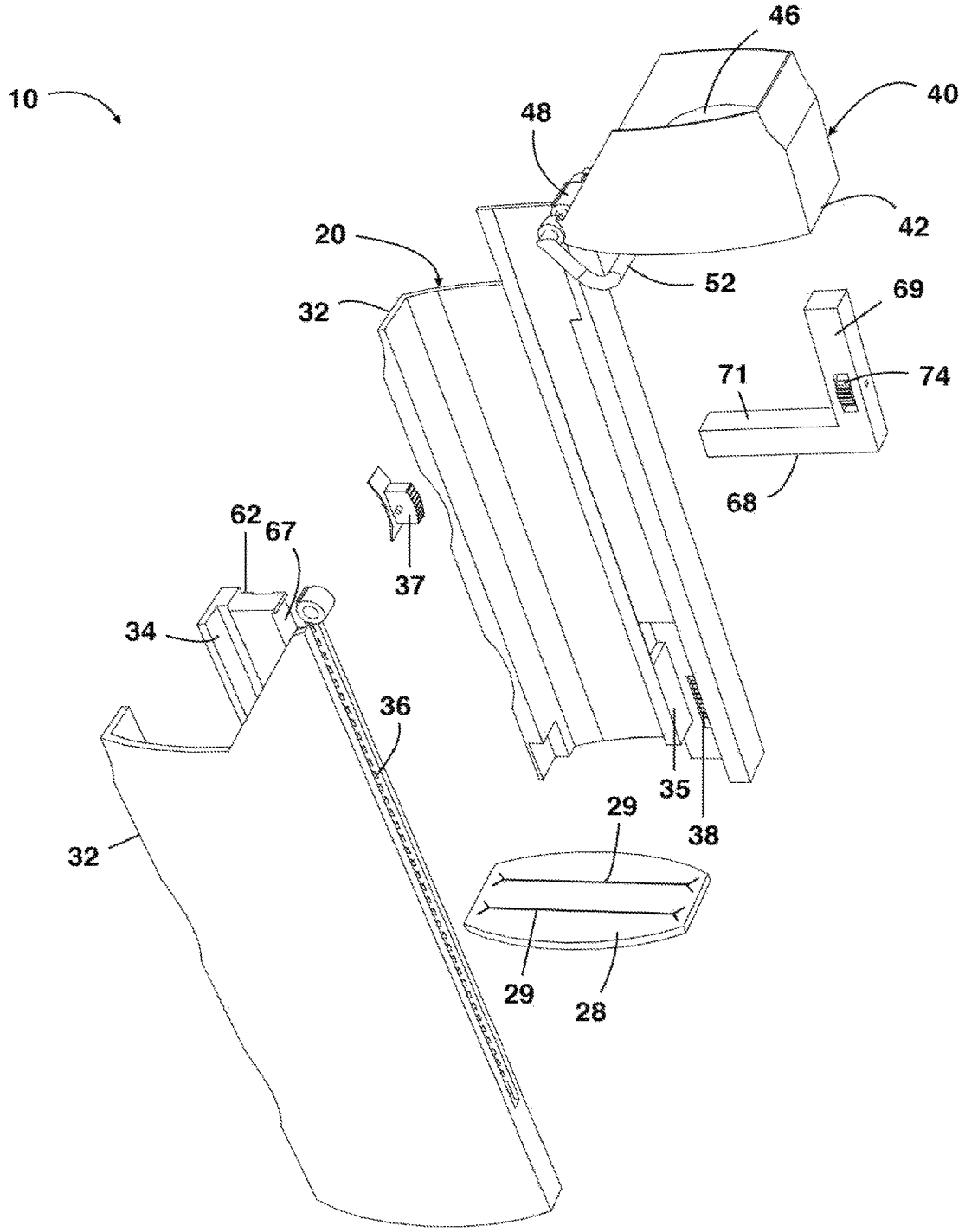
FIG. 3 illustrates another exploded view of grasping device 10.

Housing 22 may be best defined by a first portion 32 and a second portion 33, as best seen in FIGS. 2 and 3. First portion 32 and second portion 33 may be mounted and secured flushy together to assemble housing 22. On an exterior, each of first portion 32 and second portion 33 may be substantially identical. Each of first portion 32 and second portion 33 may be significantly convex.

Each of first portion 32 and second portion 33 may secure different components of hook assembly 60 thereto. More specifically, first portion 32 may have a hook 62 of the hook assembly 60 secured thereto. As best seen in FIG. 2, first portion 32 may include a hook support member 34 at a first portion inner side. In one embodiment, hook support member 34 may partially extend a length of first portion 32. Hook support member 34 may be perpendicular to first portion 32. Hook 62 may rest directly atop of hook support member 34. It is to be understood that hook 62 may be in constant abutting contact with hook support member 34 even when hook 62 is extended outwardly from housing 22, at least partially. As best seen in FIG. 3, second portion 33 may include a bumper support member 35 at a second portion inner side. In one embodiment, bumper support member 35 may partially extend a length of second portion 33. Bumper support member 35 may be perpendicular to second portion 33. Upon first portion 32 and second portion 33 being united to assemble housing 22, hook support member 34 and bumper support member 35 may be adjacent to each other and in abutting contact. It may also be suitable for hook support member 34 and bumper support member to be parallel to each other.

Located atop of first portion 32 may be a channel 36 as best seen in FIGS. 2 and 3. Channel 36 may serve as a track for a slider member 37. Within channel 36 may be a slider member track which engages slider member 37 upon any forward or rearward movement of slider member 37. The slider member track may include ridges for engaging of slider member 37. Channel 36 may be partially recessed within first portion 32 a predetermined amount. It may be suitable for channel 36 to partially extend the length of housing 22 or first portion 32. Received within channel 36 may be slider member 37. It is to be understood that slider member 37 may be movable or slidable within channel 36. Slider member 37 may partially protrude from channel 36 when secured therein. Slider member 37 may include a gripping portion at a top side to facilitate operation of slider member 37 by the user. It is to be understood that once slider member 37 is secured within channel 36, slider member 37 is further secured atop of hook 62. Slider member 37 and hook 62 move simultaneously together and in a same direction, either forwards or backwards. As slider member 37 is operated and moved by the user from front side 23 to rear side 24, so is hook 62 to retract hook 62 within housing 22. As slider member is operated and moved by the user from rear side 24 to front side 23, so is hook 62 to extend hook 62 from out of housing 22. Adjacent to channel 36 may be a hooking portion atop of first portion 32 which cooperates with lid assembly 40.

On the second portion inner side may be located an inner track 38. Inner track 38 may be a ridged track that extends partially along the length of second portion 33. Inner track 38 may be located above of bumper support member 35. Further, bumper support member 35 and inner track 38 may be perpendicular to each other. Inner track 38 may function and cooperate with hook assembly 60.

Figure 6:
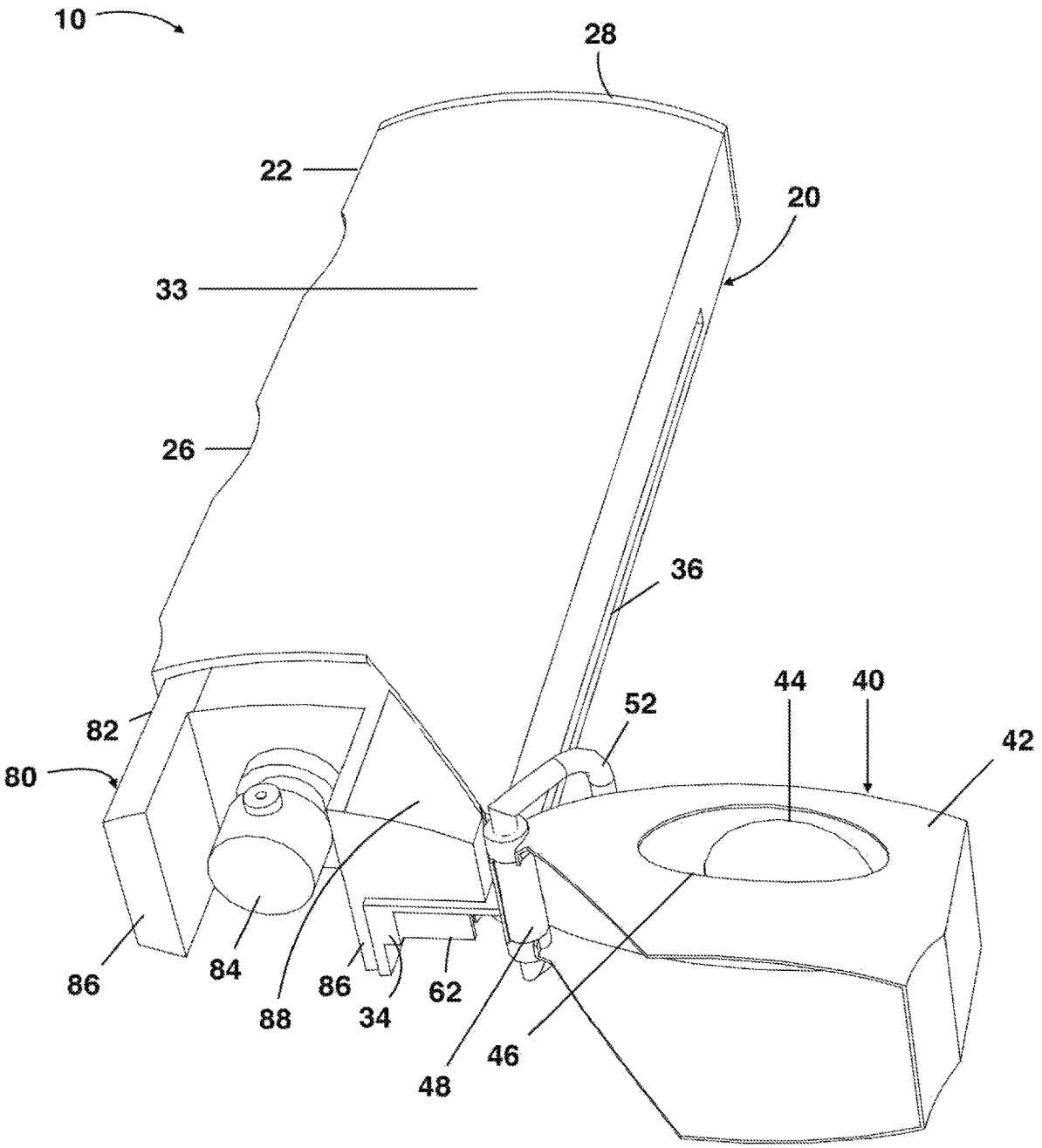
FIG. 6 shows an isometric rear view of grasping device 10 with lid assembly 40 in the open configuration and cartridge assembly 80 within grasping device 10.

As best seen in FIGS. 5 and 6, lid assembly 40 may be mounted to housing 22 at rear side 24. Lid assembly 40 may include a lid 42. More specifically, lid 42 may be mounted to second portion 33. Lid 42 may have a closed and open configuration as shown in FIGS. 5 and 6, respectively. Lid 42 may have an irregular predetermined shape. Furthermore, lid 42 may be hollow. Lid 42 may permit access to cavity 31 and also cartridge assembly 80. It is to be understood that cartridge assembly 80 may be operable with lid 42 in either of the closed or open configuration. Preferably, lid 42 may be hingedly mounted to housing 22. In one embodiment, lid 42 may include a hinge member 48. In one embodiment, hinge member 48 may be substantially on second portion 33 and cooperate with the hooking portion on first portion 32. Hinge member 48 may permit for lid 42 to achieve the closed and open configuration. As well as any additionally configurations between the closed and open configuration.

Lid 42 may include a first opening 44 and a second opening 46. Preferably, first opening 44 and second opening 46 may be perpendicular to each other. First opening 44 may be on top face of lid 42. In one embodiment, first opening 44 may be centrally mounted on lid 42. While second opening 46 may be on a lateral face of lid 42. Cartridge assembly 80 may be actuated through first opening 44 when lid 42 is in the closed configuration. Preferably, each of first opening 44 may be circular. Second opening 46 may preferably be oval or oblong. However, other shapes may be suitable for first opening 44 and second opening 46. It is to be understood that first opening 44 may preferably be smaller than second opening 46. Second opening 46 may be wider than first opening 44 in one embodiment.

Mounted to lid 42 may be a ring member 52. Ring member 52 may facilitate attaching of grasping device 10 to the user. Ring member 52 may also function as a key ring, allowing keys K to be mounted to ring member 52. Ring member 52 may permit users to maintain grasping device 10 within reach and readily available for usage. Ring member 52 may be made of materials such as wood, plastic, metal, stainless steel, rubber, acrylic, glass, or combinations thereof. In one embodiment, ring member 52 may be D shaped. In an alternate embodiment, ring member 52 may be circular. It may also be suitable for ring member 52 to be removable and optional.

Figure 7:
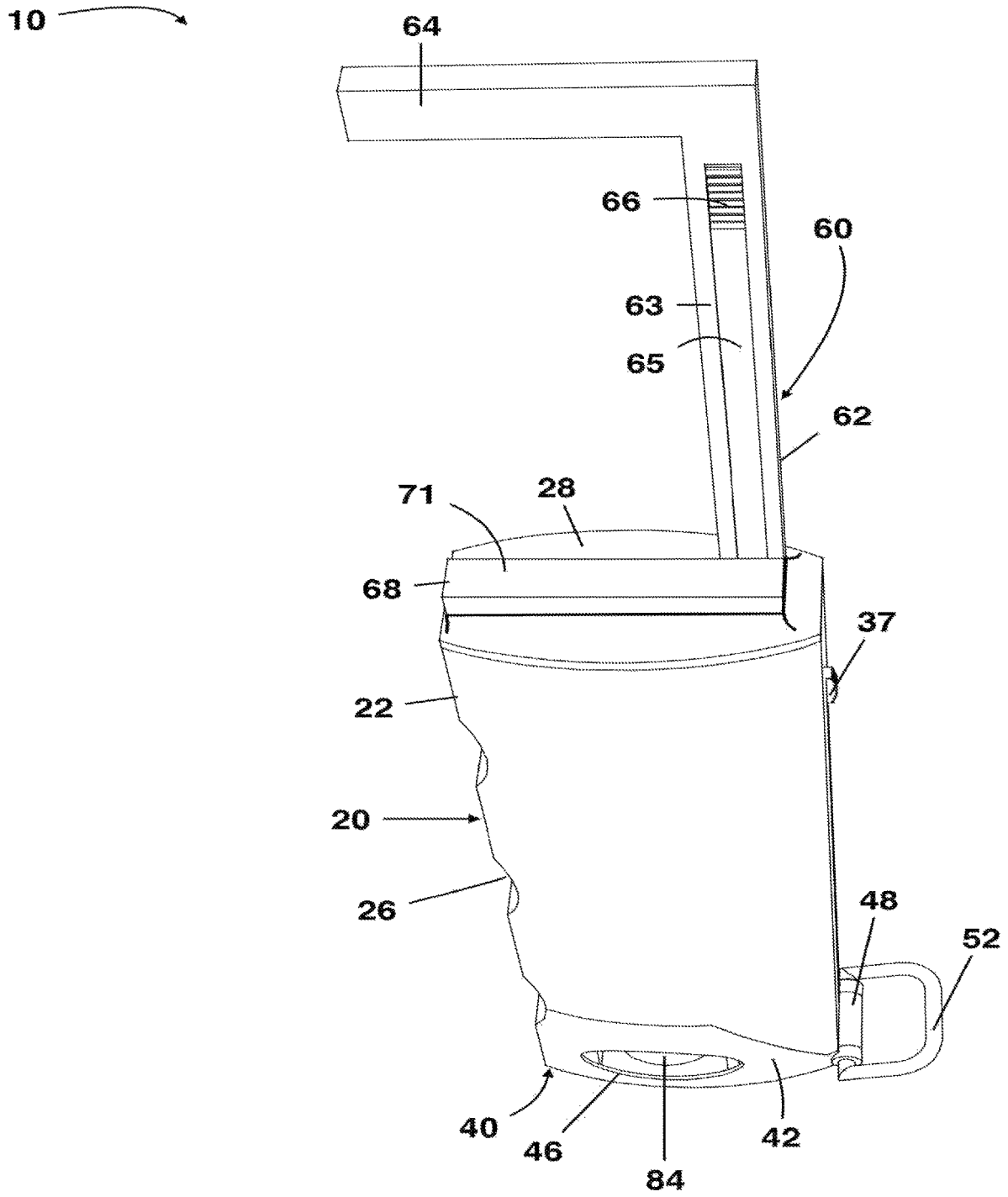
FIG. 7 illustrates an isometric front view of grasping device 10 with hook assembly 60 extending therefrom.
Figure 9:
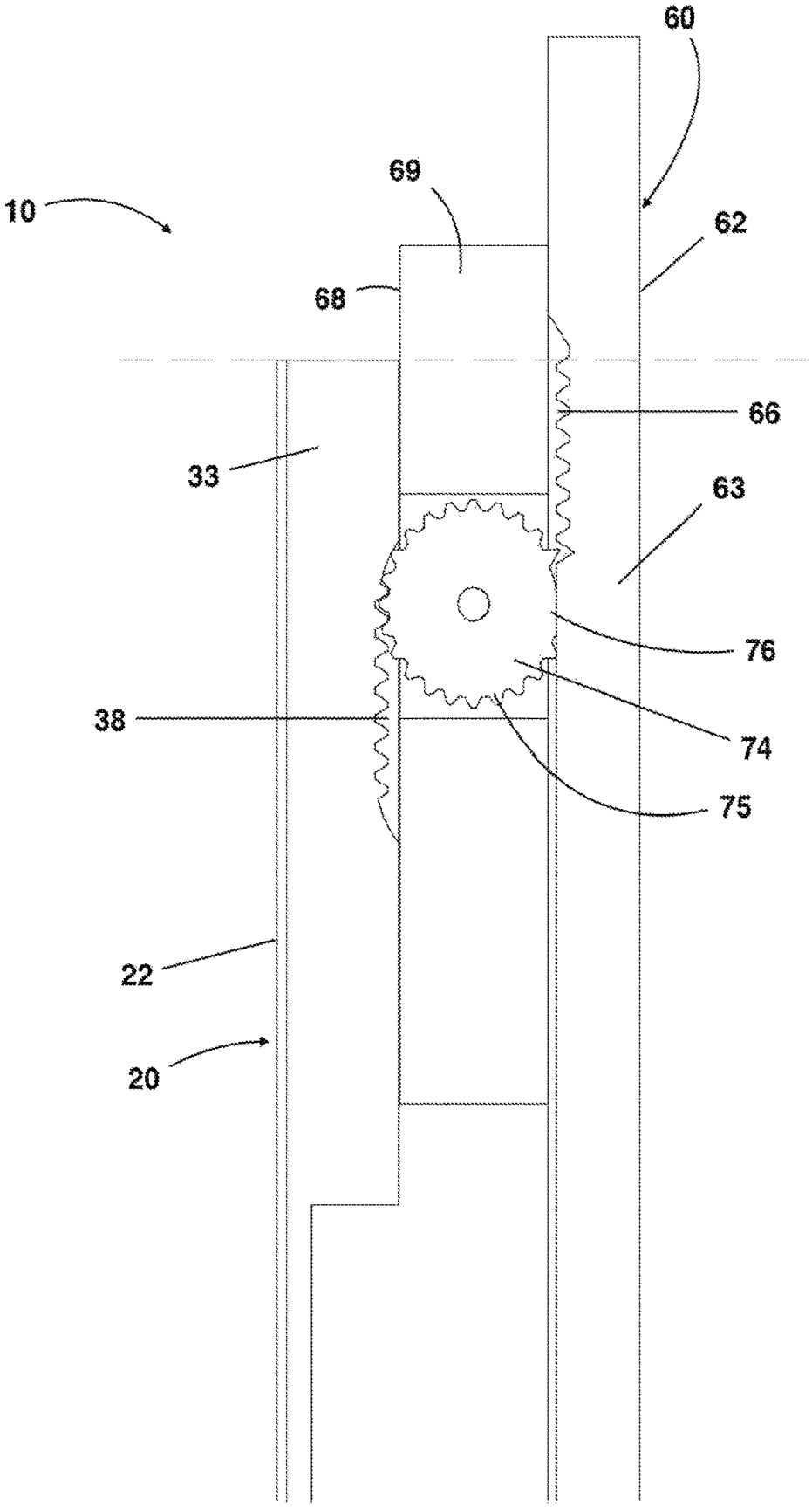
FIG. 9 represents a see-through top view of grasping device 10 showing hook assembly 60 interacting and functioning to extend from grasping device 10.
Figure 10:
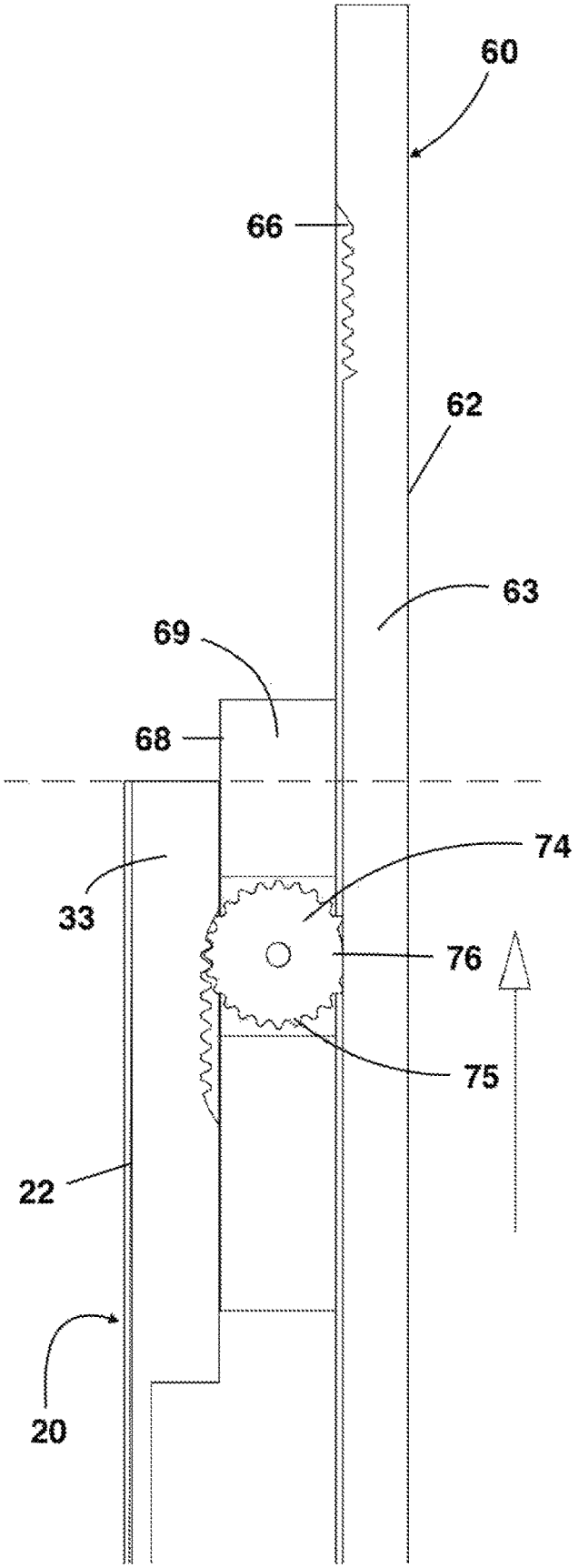
FIG. 10 shows a see-through top view of grasping device 10 showing hook assembly 60 in the fully extended configuration.

Grasping device 10 may further include hook assembly 60, as best seen in FIGS. 2 and 3. Importantly, hook assembly 60 may include a hook 62 and a bumper 68. It may be suitable for each of hook 62 and bumper 68 to be made of materials such as wood, plastic, metal, stainless steel, rubber, acrylic, glass, or combinations thereof. It may be suitable for each of hook 62 and bumper 68 to have a substantial L shape. It is to be understood that hook 62 and bumper 68 may have a retracted configuration and an extended configuration, as best seen in FIGS. 4 and 7, respectively. Preferably, hook 62 and bumper 68 may be retracted and extended simultaneously from housing 22. It is to be understood that hook 62 may have a length greater than that of bumper 68. However, bumper 68 may preferably have a width greater than that of hook 62. Within housing 22 hook 62 and bumper 68 may be adjacent and parallel to each other. Additionally, hook 62 and bumper 68 may be partially in constant abutting contact with one another when retracted or extended from housing 22, as best seen in FIGS. 9 and 10. Hook 62 and bumper 68 may partially extend the length of housing 22 in both of the retracted and extended configuration. Hook 62 and bumper 68 may extend or retract through openings 29. Openings 29 may seal themselves upon hook 62 and bumper 68 being retracted. Bumper 68 may be in constant abutting contact with bumper support member 35 even when bumper 68 is extended outwardly from housing 22.

Hook 62 may further be defined by a hook shaft 63 and a hook head 64. Hook shaft 63 and hook head 64 may be orthogonal or perpendicular to each other. Hook shaft 63 may partially extend the length of housing 22. While hook head 64 may partially extend the height of housing 22. Hook head 64 may extend downwardly and away from hook shaft 63. On the inner lateral side of hook shaft 63 may be a hook channel 65, as best seen in FIGS. 3 and 7. Hook channel 65 may be recessed within hook shaft 63 a predetermined depth. Hook channel 65 may also extend a substantial length of hook shaft 63. Adjacently to and at a distal end of hook channel 65, nearest to hook head 64, may be a hook track 66. Hook track 66 may be defined by evenly spaced apart teeth or ridges which are adjacent to each other. Hook track 66 may preferably extend vertically. Hook 62 may further include a slider holder 67 atop of hook shaft 63. Slider holder 67 may preferably be at a distal end of hook shaft 63 away from hook head 64. Slider holder 67 may receive and secure slider member 37 thereon. With slider member 37 secured on slider holder 67 hook 62 can easily be slid forward or backwards upon grasping device 10 being assembled.

Bumper 68 may further be defined by a bumper shaft 69 and a bumper head 71. Bumper shaft 69 and bumper head 71 may be orthogonal or perpendicular to each other. Bumper shaft 69 may partially extend the length of housing 22. While bumper head 71 may partially extend the height of housing 22. Bumper head 71 may extend downwardly and away from bumper shaft 69. Bumper head 71 may prevent a contaminated surface to make contact with cover 28 to further protect the user from indirect contact with infectious diseases or agents as grasping device 10 is being handled. If bumper head 71 does make contact with an infected surface, then the user never makes contact with the infected bumper head 71. Extending through bumper shaft 69 may be a through hole 72. In one embodiment, through hole 72 may be square shaped. Other shapes may be suitable for through hole 72. Secured within through hole 72 may be a gear 74. Gear 74 may be secured with a fastening member. It is to be understood that gear 74 may rotate within through hole 72 once engaged and actuated. Gear 74 may have a width less than that of through hole 72. Gear 74 may further include gear teeth 75 which extend partially about the perimeter of gear 74. Gear 74 may further include a smooth portion 76 about the perimeter of gear 74 where gear teeth 75 are absent.

Gear 74 may be responsible for hook 62 and bumper 68 moving concurrently in and out of housing 22, as illustrated in FIGS. 9 and 10. Upon slider member 37 being actuated and moved towards front side 23 by the user, hook 62 subsequently does the same. While hook 62 is within housing 22, gear 74 may engage hook track 66. More specifically, gear teeth 75 may be engaged with hook track 66. The forward movement of hook 62 causes gear 74 to rotate until gear teeth 75 disengage hook track 66. Gear 74 rotates and gear teeth 75 rotate to engage inner track 38 of second portion 33 instead. This rotation of gear 74 causes for smooth portion 76 to then be in contact with hook channel 65. Hook 62 can then smoothly glide against smooth portion 76 and out of housing 22. Hook 62 may extend outwardly until gear 74 reaches the end of hook channel 65. Bumper 68 may extend outwardly until gear 74 or gear teeth 75 reach the of inner track 78. Thereby resulting in hook 62 and bumper 68 being extended out of housing 22. To retract hook 62 and bumper 68 the inverse occurs. Such that a rearward movement of hook 62 causes smooth portion 76 to glide against hook channel 65 until gear teeth 75 engage hook track 66. Once gear teeth 75 and hook track 66 are engaged then gear 74 begins to rotate. Gear 74 continues to rotate as hook 62 is retracted until gear teeth 75 have entirely engaged hook track 66 and smooth portion 76 is in abutting contact with inner track 38. Upon retract hook 62 and bumper 68 are extended or retracted, hook 62 slides along hook support member 34 and bumper slides along bumper support member 35.

Figure 8:
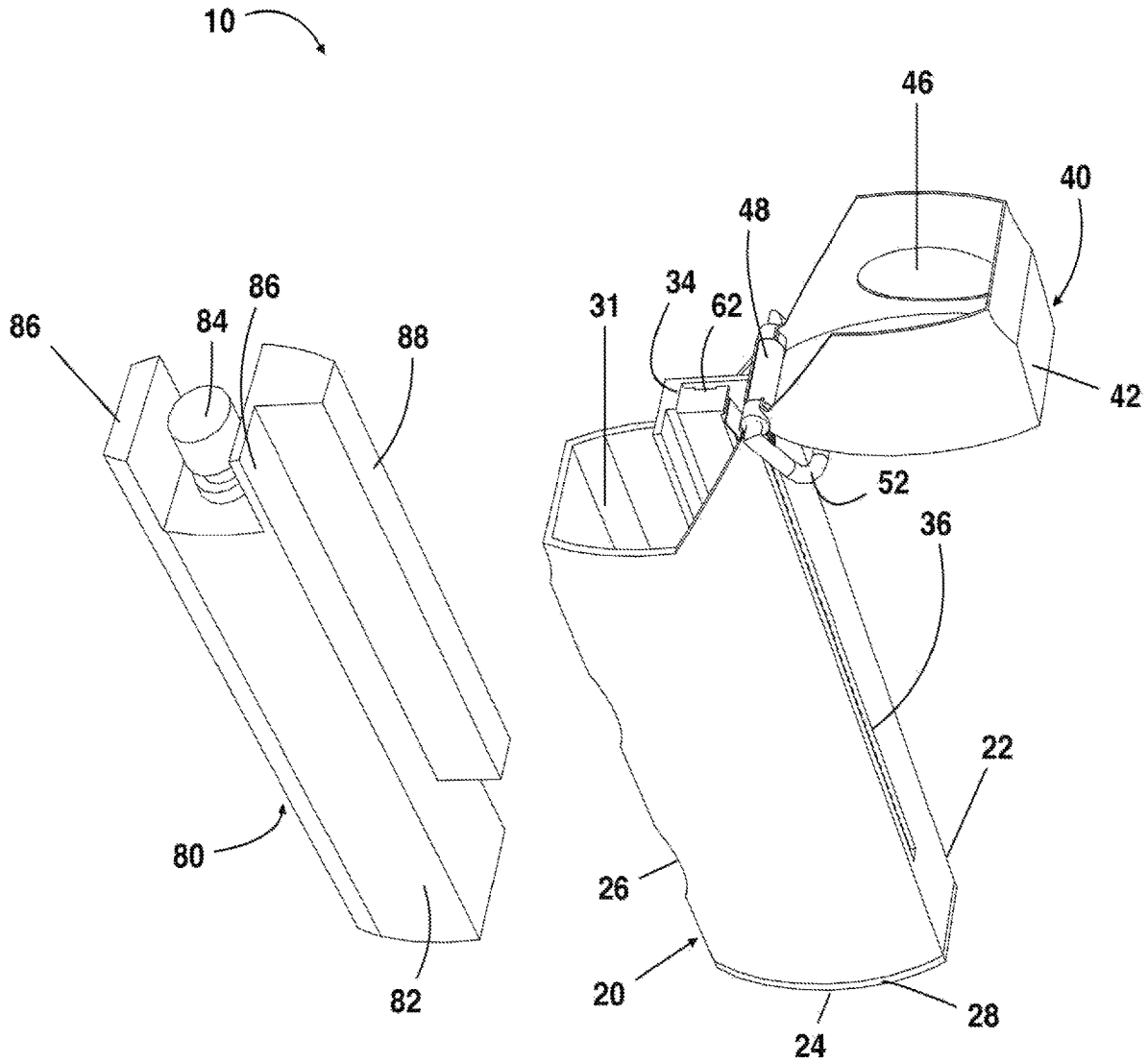
FIG. 8 is a representation of an isometric rear view of grasping device 10 with cartridge assembly 80 removed therefrom.

Grasping device 10 may further include cartridge assembly 80, as best shown in FIG. 8. Cartridge assembly 80 may be removable from housing 22. Cartridge assembly 80 may include cartridge 82. In one embodiment, cartridge 82 may be disposable and replaceable. In an alternate embodiment, cartridge 82 may be refillable. Cartridge 82 may be made of materials such as wood, plastic, metal, stainless steel, rubber, acrylic, glass, or combinations thereof. In the preferred embodiment, cartridge 82 may be of an irregular shape. Cartridge 82 may be removably received within cavity 31. Cartridge 82 may preferably extend the entire length of housing 22. In one embodiment, cartridge 82 may entirely fill cavity 31. It may be suitable for cartridge to extend outwardly from cavity 31 as well. Cartridge 82 may house a sanitation solution that may be used for cleaning or disinfecting the user or surfaces.

Cartridge 82 may further include a nozzle 84 mounted on a top surface of cartridge 82. Nozzle 84 may be actuated to release the contents of cartridge 82 as needed by the user. Nozzle 84 may be actuated with a press from the user. Preferably, nozzle 84 may be actuated by the user with lid 42 closed through first opening 44. Subsequently, nozzle 84 may release or spray the contents of cartridge 82 through second opening 46. It may also be suitable to actuate nozzle 84 with lid 42 in the open configuration. Nozzle 84 may preferably have a diameter less than that of first opening 44 and second opening 46.

Cartridge 82 may further include sidewalls 86. Sidewalls 86 may extend along the length of cartridge 82. Sidewalls 86 may be located on opposing sides of nozzle 84. Nozzle 84 may be found between sidewalls 86. It can be seen that sidewalls 86 may be parallel to each other and nozzle 84. In one embodiment, sidewalls 86 may extend above of nozzle 84. Sidewalls 86 may extend outwardly and away from nozzle 84. Cartridge 82 may further include a protrusion 88 that may extend outwardly and away from cartridge 82. It may be suitable for protrusion 88 to be mounted onto one of sidewalls 86. Protrusion 88 may extend a partial length of cartridge 82. Protrusion 88 may be substantially rectangular in one embodiment. Protrusion 88 may provide cartridge 82 with added volume to store and hold more of a sanitation solution therein.

Grasping device 10 allows the user to be readily able to avoid contact with infected surfaces or items to prevent the spreading of infectious diseases or agents through indirect contact. Grasping device 10 is also able to dispense a sanitizing solution to help increase the sanitation and health of the user. Grasping device 10 being portable allows the user to avoid infectious diseases or agents even when the infectious diseases or agents are present unknowingly.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a grasping device, comprising:

a. a housing having a front side and a rear side;

b. a hook assembly including a hook and a bumper, said hook and said bumper housed within said housing, said hook and said bumper being slidably extendable and retractable from said housing, said hook and said bumper being in abutting contact with said housing when said hook and said bumper are extended or retracted from said housing; and c. a cartridge assembly including a cartridge removably enclosed within said housing, said cartridge having a nozzle to dispense the contents of said cartridge, said nozzle extending away from said hook.

2. The system of claim 1, wherein said front side includes a cover mounted thereto, said cover including openings, said hook and said bumper extend and retract from said housing through said openings.

3. The system of claim 2, wherein said openings are adjacent and parallel to each other, said openings extend vertically along said cover.

4. The system of claim 1, wherein said housing includes a grip portion extending along a bottom side of said housing from said front side to said rear side, said grip portion adapted for ergonomic usage of the grasping device by a user.

5. The system of claim 1, wherein said housing includes a cavity, said cavity permitting access to an interior of said housing from said rear side, said cavity extending an entire length of said housing, said cartridge received within said cavity.

6. The system of claim 1, wherein said cartridge includes sidewalls, said sidewalls extending above of said nozzle, said nozzle being located between said sidewalls, said nozzle and said sidewalls being parallel to each other, said cartridge further including a protrusion mounted to one of said sidewalls, said protrusion extending outwardly and away from one of said sidewalls, said protrusion extend a partial length of said cartridge.

7. The system of claim 1, wherein a first portion of said housing includes a hook support member on an inner first portion side, said hook sitting atop of said hook support member, said hook support member extending a length of said first portion.

8. The system of claim 1, wherein a second portion of said housing includes a bumper support member on an inner second portion side, said bumper sitting atop of said bumper support member, said bumper support member extending a length of said second portion.

9. The system of claim 7, wherein atop of said first portion extends a channel, said channel being recessed within said first portion.

10. The system of claim 9, wherein a slider member is slidable within said channel, said slider member mounted onto said hook on a slider holder of said hook, said slider member and said hook moving simultaneously in a same direction.

11. The system of claim 8, wherein an inner track is located on said inner second portion side, said inner track being above of said bumper support member.

12. The system of claim 1, wherein a lid assembly including a lid is mounted to said housing at said rear side, said lid mounted to said housing with a hinge member, said hinge member extending a width of said housing.

13. The system of claim 12, wherein said lid includes a first opening and a second opening, said first opening and said second opening being perpendicular to each other, said second opening having a diameter greater than that of said first opening, said nozzle actuated through said first opening and said nozzle dispensing the contents of said cartridge through said second opening.

14. The system of claim 12, wherein a ring member is mounted to said lid, said ring member swiveling about said hinge member, said ring member extending outwardly and away from said hinge member.

15. The system of claim 7, wherein said hook includes a hook shaft and a hook head, said hook head being entirely extendable from said housing, said hook head extending perpendicularly to said hook shaft, said hook head extending below said hook support member.

16. The system of claim 15, wherein said hook includes a hook channel extending along a lateral side of said hook shaft, said hook further including a hook track at a distal end of said hook channel nearest to said hook head.

17. The system of claim 11, wherein said bumper includes a bumper shaft and a bumper head, said bumper head being partially extendable from said housing, said bumper head extending perpendicularly to said bumper shaft, said bumper head extending below said bumper support member, said bumper shaft including a through hole.

18. The system of claim 17, wherein a gear is secured within said through hole.

19. The system of claim 18, wherein said gear includes gear teeth partially extending about the perimeter of said gear, said gear further including a smooth portion where said gear teeth are absent.

20. The system of claim 19, wherein said gear engages said hook and said inner track to causes said hook and said bumper to move simultaneously in a same direction.

* * * * *